US008212755B2

(12) United States Patent
Tanaka et al.

(10) Patent No.: US 8,212,755 B2
(45) Date of Patent: Jul. 3, 2012

(54) LIQUID CRYSTAL DISPLAY DEVICE AND DRIVING METHOD OF THE SAME

(75) Inventors: Ryo Tanaka, Yokohama (JP); Mikio Ohshiro, Yokohama (JP); Toshihiro Kojima, Zama (JP); Kohichi Katagawa, Zama (JP)

(73) Assignee: Sharp Kabushiki Kaisha, Osaka (JP)

( * ) Notice: Subject to any disclaimer, the term of this patent is extended or adjusted under 35 U.S.C. 154(b) by 478 days.

(21) Appl. No.: 11/920,922

(22) PCT Filed: May 1, 2006
(Under 37 CFR 1.47)

(86) PCT No.: PCT/JP2006/309072

§ 371 (c)(1),
(2), (4) Date: Mar. 15, 2010

(87) PCT Pub. No.: WO2006/126373

PCT Pub. Date: Nov. 30, 2006

(65) Prior Publication Data

US 2010/0207859 A1 Aug. 19, 2010

(30) Foreign Application Priority Data

May 24, 2005 (JP) ..... 2005-151033

(51) Int. Cl.
*G09G 3/36* (2006.01)

(52) U.S. Cl. ..... 345/89; 345/87; 345/208

(58) Field of Classification Search ..... 345/87–104, 345/204–215, 690–699
See application file for complete search history.

(56) References Cited

U.S. PATENT DOCUMENTS

| | | | | |
|---|---|---|---|---|
| 5,386,217 | A | 1/1995 | Liu et al. | |
| 6,222,515 | B1 * | 4/2001 | Yamaguchi et al. | 345/89 |
| 6,788,280 | B2 * | 9/2004 | Ham | 345/89 |
| 6,819,311 | B2 | 11/2004 | Nose et al. | |
| 6,952,192 | B2 | 10/2005 | Ohmuro et al. | |
| 7,161,575 | B2 * | 1/2007 | Ham | 345/98 |
| 7,463,224 | B2 | 12/2008 | Sano | |
| 7,468,716 | B2 * | 12/2008 | Lee et al. | 345/89 |
| 7,495,643 | B2 * | 2/2009 | Ham | 345/89 |

(Continued)

FOREIGN PATENT DOCUMENTS

JP 9-54306 2/1997

(Continued)

OTHER PUBLICATIONS

Taiichiro Kurita. "Fundamental Deteriorations in LCD Moving Image Quality and Improvement Methods Therefor." Technical Report of Institute of Electronics, Information and Communication Engineers, EID2000-47, p. 13-18 (Sep. 22, 2000), and English translation thereof.

(Continued)

*Primary Examiner* — Amare Mengistu
*Assistant Examiner* — Dmitriy Bolotin
(74) *Attorney, Agent, or Firm* — Harness, Dickey & Pierce, P.L.C.

(57) ABSTRACT

There is provided a liquid crystal display device having a liquid crystal panel including a plurality of gate lines to select a pixel and a plurality of data lines to supply pixel data, and a drive circuit dividing one frame into a plurality of fields, converting the frame data to field data, and supplying the field data to the data line.

17 Claims, 6 Drawing Sheets

U.S. PATENT DOCUMENTS

| | | | | |
|---|---|---|---|---|
| 7,532,186 | B2 * | 5/2009 | Tsai et al. | 345/89 |
| 7,932,915 | B2 * | 4/2011 | Miyata et al. | 345/690 |
| 8,072,407 | B2 * | 12/2011 | Tanaka et al. | 345/94 |
| 8,111,225 | B2 * | 2/2012 | Hayashi et al. | 345/89 |
| 2001/0003448 | A1 | 6/2001 | Nose et al. | |
| 2003/0015692 | A1 | 1/2003 | Teng et al. | |
| 2003/0048246 | A1 * | 3/2003 | Ham | 345/87 |
| 2003/0048247 | A1 * | 3/2003 | Ham | 345/87 |
| 2003/0052847 | A1 * | 3/2003 | Okishiro et al. | 345/87 |
| 2003/0058264 | A1 | 3/2003 | Takako | |
| 2003/0156092 | A1 | 8/2003 | Suzuki et al. | |
| 2004/0196229 | A1 * | 10/2004 | Ham | 345/87 |
| 2004/0246224 | A1 * | 12/2004 | Tsai et al. | 345/100 |
| 2005/0024351 | A1 | 2/2005 | Sano | |
| 2005/0062703 | A1 * | 3/2005 | Lee et al. | 345/89 |
| 2006/0017677 | A1 | 1/2006 | Ohmuro et al. | |
| 2007/0115246 | A1 * | 5/2007 | Hayashi et al. | 345/102 |
| 2007/0120799 | A1 * | 5/2007 | Tanaka et al. | 345/98 |

FOREIGN PATENT DOCUMENTS

| | | | |
|---|---|---|---|
| JP | 9-054306 | | 2/1997 |
| JP | 2000-231091 | | 8/2000 |
| JP | 2002-221702 | | 8/2002 |
| JP | 2003-84742 | | 3/2003 |
| JP | 2003-172915 | | 6/2003 |
| JP | 2003-241721 | | 8/2003 |
| JP | 2004-233949 | | 8/2004 |
| JP | 2004-287139 | | 10/2004 |
| TW | 589476 | | 6/2004 |
| TW | 200506773 | A1 | 2/2005 |

OTHER PUBLICATIONS

Office Action for Taiwanese patent application No. 95118361 dated Dec. 7, 2010.

* cited by examiner

LIQUID CRYSTAL DISPLAY DEVICE AND DRIVING METHOD OF THE SAME

TECHNICAL FIELD

The present invention relates to a liquid crystal display device and a driving method of the same.

BACKGROUND ART

A liquid crystal display device has been widespread as a monitor for a PC (Personal Computer) in view of its thinness, lightness and low power consumption. Recently, as a digital television becomes prevalent, a liquid crystal panel for a television which can realize high resolution is increasingly demanded and display quality close to that of a CRT is required. In particular, it is known that a response speed of the liquid crystal display device is slower compared with that of the CRT, and it is of urgent necessity to improve the response speed to realize superior moving image performance.

Slowness of a response of a liquid crystal molecule itself is first cited as a reason for the slow response speed of the liquid crystal display device. There is a problem that, at a low temperature, a low tone or the like, a liquid crystal cannot respond within one frame period and as a result a blur or an afterimage occurs in a moving image. It is also known that since the liquid crystal display device performs display by using light by a lighting system on a back face and continues to light during one frame period, the liquid crystal display device is inferior in the moving image performance compared with the CRT or a plasma display device, in which pulse lighting is performed during one frame. The former is called a hold type display, while the latter is called an impulse type display. The hold type display is described in Non-patent Document 1 below.

As a technology to improve the response speed itself of the liquid crystal display device, there is an already well-known overdrive technology as shown in FIG. 8. In a normal driving 801 and an overdrive driving 802, response waveforms of luminances are shown in an upper side while data waveforms are shown in a lower side. In the normal driving 801, effective voltages 803 indicate effective voltages of the data waveform and a response time T2 indicates a response time (time when luminance ratio is 10% to 90%) of the luminance of one frame FR1. In the overdrive driving 802, an effective voltage of the data waveform is increased from that of the normal driving 801 by an increment 804, so that a response time T3 of a luminance of one frame FR1 is shorter than the response time T2.

Normally, the liquid crystal is more responsive as an applied voltage becomes high, and the overdrive driving 802 is a method in which a higher voltage than a data voltage originally supposed to be applied is applied at a rise time of the response, so that the response of the liquid crystal is accelerated and the response speed in a tone with a slow response speed is improved. In contrast, at a fall time of the response, the response is accelerated by applying a lower voltage than the original data voltage.

As for the increment (correction value) 804 of the effective voltage, there are known a method of determining a correction value of an "m"th frame by data comparison of the "m"th frame and an "m−1"th frame, a method of determining a correction value of an "m−1"th frame by data comparison of an "m−2"th frame, the "m−1"th frame, and an "m"th frame, and so on.

However, in the conventional driving, though the response speed can be improved by applying the higher voltage than the original data voltage in a first frame period (1/driving frequency), the response time can be only improved, at a maximum, to a degree to about 16 ms equivalent to one frame period at a time of 60 Hz driving, in a tone in which a response speed of the liquid crystal itself is slow.

Further, in a VA-type liquid crystal panel, there is confirmed a phenomenon that alignment disorder of liquid crystal molecules becomes apparent at a time of high voltage application. As shown in FIG. 9, in a VA method, liquid crystal molecules 901 vertically aligned at a time of no voltage application (black display time) starts to fall by a structure disposed in a panel or by an electric field direction, as the voltage is applied. At a maximum applied voltage, the display becomes white display and liquid crystal molecules 902 and 903 fall to a maximum level. The liquid crystal molecules 902 are liquid crystal molecules of the white display at the normal time and have a liquid crystal alignment direction 912. The liquid crystal molecules 903 are liquid crystal molecules of the white display at a time of abnormal alignment and have a liquid crystal alignment direction 913. At the time of the white display, though it is desirable that the liquid crystal molecules fall in a proper alignment direction, there may occur a variation in the alignment direction if the liquid crystal molecules fall by a rapid application of a voltage.

FIG. 10 is a graph showing a one-frame overdrive driving 1001 and a two-frame overdrive driving 1002. In the one-frame overdrive driving 1001, an effective voltage of a data waveform of only a first frame FR1 is increased by an increment 1007 by overdrive. In the two-frame overdrive driving 1002, an effective voltage of a data waveform of a first frame FR1 is increased by an increment 1005 while an absolute value of an effective voltage of a data waveform of a second frame FR2 is increased by an increment 1006. In the liquid crystal molecules 902 of the normal time in FIG. 9, a luminance 1004 is improved by overdrive of the second frame FR2. However, in the liquid crystal molecules 903 of the abnormal alignment time in FIG. 9, a luminance 1003 of a second frame FR2 is reduced by disorder of the liquid crystal alignment.

Liquid crystal molecules in a proper alignment direction maximally contribute to a luminance, but the molecule misaligned from the alignment direction causes deterioration of the luminance. Though the abnormally aligned liquid crystal molecule returns to the proper alignment direction with time by an alignment restriction force in the panel, the luminance reduction may influence a response waveform of the second frame FR2. In other words, the luminance reduction also influences a moving image characteristic and thus, a conversion of the data voltage in the second frame FR2 is required.

In this case, two frames (32 ms) are required in order to reach an original data voltage level, and this is one of causes to deteriorate the moving image characteristic.

In Patent Document 1 below, there is disclosed a technology to perform overdrive driving for two consecutive frames.

Patent Document 1: Japanese Patent Application Laid-open No. 2000-231091

Non-patent Document 1: Technical Report of Institute of Electronics, Information and Communication Engineers, EID2000-47, p 13-18 (2000-09)

SUMMARY OF THE INVENTION

An object of the present invention is to enable liquid crystal display in which a response time can be made further shorter than one frame period and which is superior in moving image display.

According to one aspect of the present invention, there is provided a liquid crystal display device having: a liquid crystal panel including a plurality of gate lines to select a pixel and a plurality of data lines to supply pixel data; and a data driver dividing one frame into a plurality of frames, converting frame data to field data, and supplying the field data to the data line.

DETAILED DESCRIPTION OF THE PREFERRED EMBODIMENTS

First Embodiment

Figure 1:
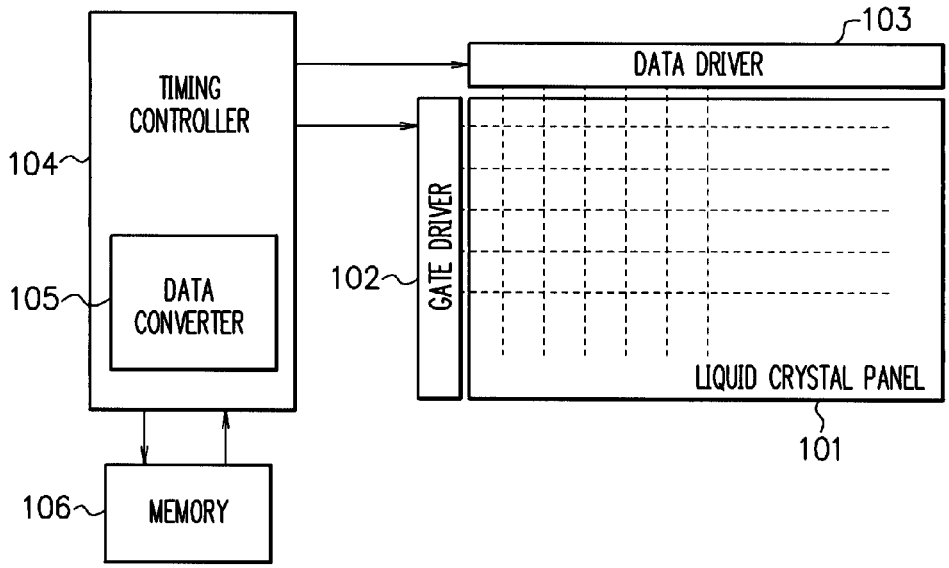
FIG. 1 is a diagram showing a circuit configuration example of a first embodiment.

FIG. 1 is a diagram showing a configuration example of a liquid crystal display device according to a first embodiment of the present invention. A timing controller 104 includes a data converter 105 and is able to perform reading and writing from/to a memory 106. The data converter 105 divides one frame into a plurality of fields and converts frame data to field data. A gate driver 102 supplies a gate pulse voltage to a gate line (scanning line) in a liquid crystal panel 101 per field, under control of the timing controller 104. The gate line is a line for selecting a pixel. A data driver 103 supplies a data voltage to a data line (signal line) in the liquid crystal panel 101 per field, under control of the timing controller 104. The data line is a line for supplying pixel data. The liquid crystal panel 101 has a plurality of the gate lines and a plurality of the data lines crisscrossing each other, and has at a crisscrossing portion thereof an array substrate having an active element (TFT: Thin Film Transistor) and a counter substrate on which at least an ITO is formed. The array substrate and the counter substrate sandwich a liquid crystal layer therebetween. The above-described TFT is disposed in each pixel. Part or all of the TFT is formed of polysilicon. A gate of the TFT is connected to the gate line while a drain of the TFT is connected to the data line. When a gate pulse is supplied to the gate line, the TFT corresponding thereto is turned on, so that the pixel of that TFT can be selected. In the pixel of the selected TFT, an alignment direction of liquid crystal molecules are determined in correspondence with the data voltage supplied to the data line, a transmission amount of light is determined, and a tone value of that pixel can be controlled.

Figure 2:
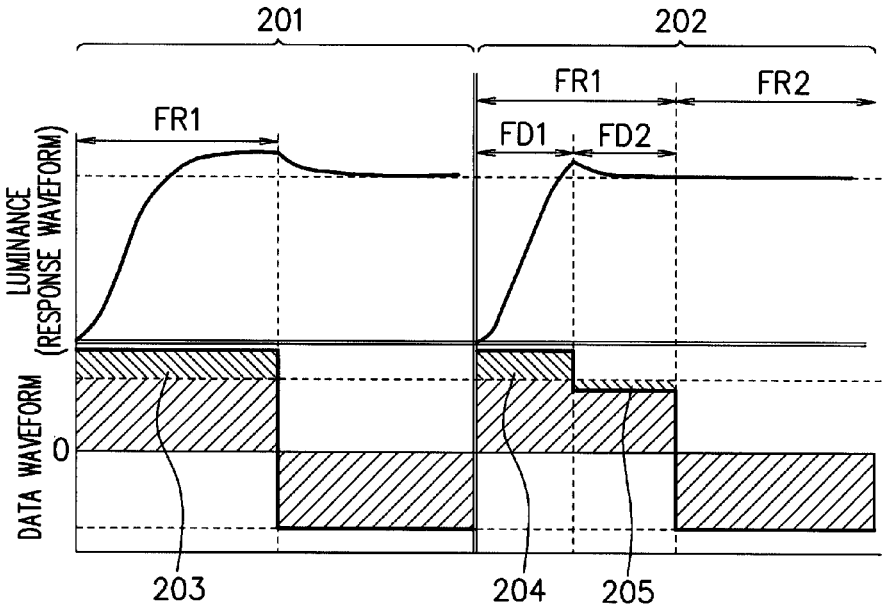
FIG. 2 is a graph showing a response at a time of frame division of the first embodiment.

FIG. 2 is a graph showing a normal overdrive driving 201 and a one-frame two-division overdrive driving 202. In the normal overdrive driving 201 and the one-frame two-division overdrive driving 201, response waveforms of luminances are shown in an upper side while data waveforms of the data line are shown in a lower side. Note that "0" of the data waveform does not mean ground. In the normal overdrive driving 201, an effective voltage of a data waveform of a first frame FR1 increases by an increment 203.

In the one-frame two-division overdrive driving 202, a first frame FR1 is divided into a first field FD1 and a second field FD2 to perform overdrive driving, and overdrive driving of a second frame FR2 is not performed. In the first field FD1, the overdrive driving is performed with an effective voltage of a data waveform being increased by an increment 204, so that a response speed of a luminance is increased. In a second field FD2, an effective voltage of a data waveform is decreased by a decrement 205. The gate pulse is supplied to the gate line per field. The data voltage waveform is of an AC type in which positive and negative signs are reversed per frame. All polarities of the data voltages of "n" (for example, "2") fields divided from one frame are the same.

As the present embodiment, it will be considered a case that one frame period is divided into two fields. A drive circuit of the liquid crystal display device is provided with the memory 106 and the data converter 105 to correct the data voltage, as shown in FIG. 1. The data converter 105 compares data of a previous frame and a present frame, read a correction value on a data conversion table of the memory 106 based on a comparison result, and adds the correction value to a data signal of the field of the present data, whereby the data is converted. The converted data goes from the timing controller 104 through the data driver 103 and is applied to the TFT of the pixel. This conversion is performed to data of two fields in one frame.

As in FIG. 2, the converted data of the first field FD1 has an effect to accelerate the response speed of the liquid crystal to make the response speed faster, by applying a voltage higher than an original voltage for a rise of the data waveform, similarly to in the normal overdrive technology. The converted data of the second field FD2 is applied for the purpose of making a pixel voltage having been excessively applied in the first field FD1 back to a desired pixel voltage. In this graph, in order to make the voltage back to the desired voltage, a voltage slightly lower than the desired voltage is applied. The data correction of the second field FD2 is also effective to the above-stated luminance decrease due to the abnormal alignment of the liquid crystal molecules at the time of the high voltage application.

Whether to apply the voltage higher or lower than the desired data voltage to the second field FD2 is determined by a degree of the above-described luminance reduction due to the abnormal alignment and a degree of the returning to the desired data voltage from the high voltage in the first field FD1. However, as for a response from black (minimum tone value) to white (maximum tone value), the above-described application of the voltage higher than the original data voltage cannot be performed exceptionally, since a white voltage is a maximum data voltage value that can be outputted.

Though in the normal overdrive driving 201, a response speed of a halftone response is 16 ms or less, sometimes 16 ms or more, a response speed of 8 ms or less can be realized for all tones in the one-frame two-division overdrive driving 202. Further, by using the converted data also in the second field FD2, it becomes possible to reach a desired pixel electric potential within one frame FR1, so that remedy for a blur or an afterimage in a moving image is realized.

In the above example, the number of the fields in one frame period is two, and the converted data voltage is applied in each field. Also in a case of dividing into "n" fields, the data voltage application is performed by employing the above-described converted data in all fields. When "n" is large, the pixel electric potential reaches the desired data electric potential before the "n"th field, and the converted data may be the same as the original data, by applying data corrected with the correction value of the converted data being "0 (zero)" and so on after the pixel electric potential becomes stable.

Second Embodiment

Figure 3:
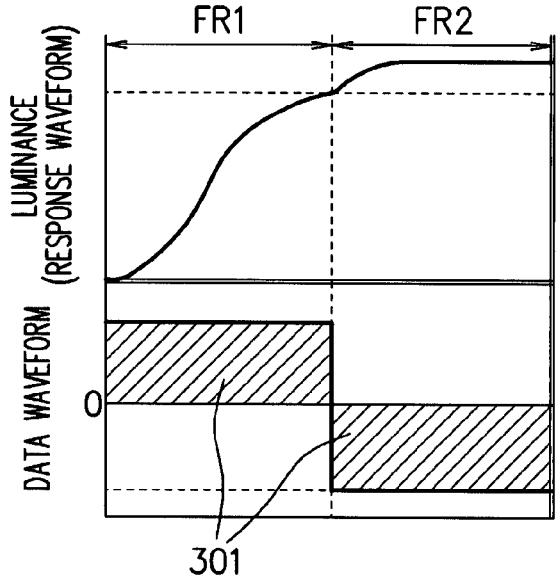
FIG. 3 is a graph showing a two-step response of a second embodiment.

As a second embodiment of the present invention, a black and white response will be referred to. As shown in FIG. 3, a luminance of a frame FR1 changes from black to white by applying a white data voltage. However, the luminance does not reach a desired white luminance. In a subsequent frame FR2, by further applying a white data voltage, the desired white luminance can be reached.

In the response to black to white, a maximum data voltage that the white voltage can use is normally employed, and so the above-described overdrive driving cannot be applied thereto. Further, in a response in which a difference between the data voltages is large such as from black to white, liquid crystal capacitors Clc are different at a black display time and at a white display time, so that only a voltage lower than the desired pixel voltage may be able to be applied to the pixel even if the white voltage is applied.

An electric charge quantity Q of the black display time is represented by the following formula based on a liquid crystal capacitor Clb of the black display time, a storage capacitor Cs, and a white voltage V. The storage capacitor Cs is connected parallel to the liquid crystal capacitor.

$$Q=(Clb+Cs)V$$

An electric charge quantity Q' of the white display time is represented by the following formula based on a liquid crystal capacitor Clw of the white display time, the storage capacitor Cs, and a voltage V' of an end time of the frame FR1.

$$Q'=(Clw+Cs)V'$$

Since the liquid crystal capacitor Clb of the black display time and the liquid crystal capacitor Clw of the white display time are different and the electric charge quantities Q and Q' are not the same, only the voltage V' lower than the desired pixel voltage can be applied to the pixel even if the white voltage V is applied. In other words, the voltage V' of the end time of the frame FR1 is lower than the white voltage V.

As a remedial measure for the above, there is a method in which a ratio of the liquid crystal capacitor is decreased in relation to a capacitor of the pixel by increasing the storage capacitor Cs, which is parallelly connected to the liquid crystal capacitor. However, in order to completely eliminate a two-step response, an unrealistic size of storage capacitor Cs is required. Further, even when improvement of the luminance can be expected by applying a voltage higher than the white voltage (when a T-V curve is not saturated at the white voltage), the above-described abnormal alignment of the liquid crystals occurs as the higher voltage is applied, and the improvement in the response is not always obtained.

Figure 4:
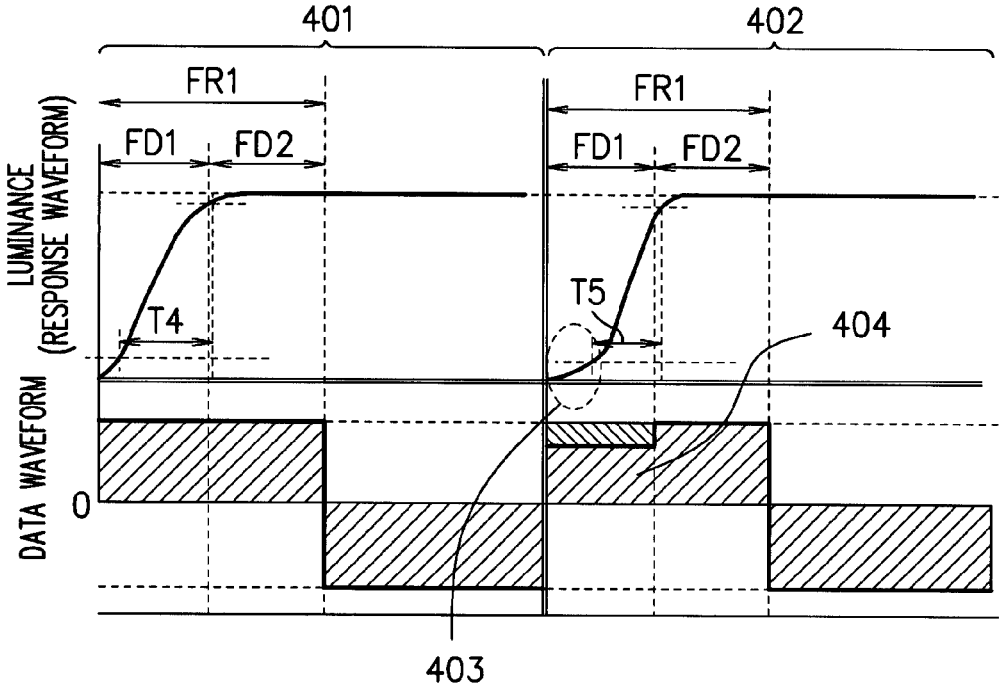
FIG. 4 is a graph showing a white response at a time of halftone insertion of the second embodiment.

FIG. 4 shows a driving 401 in which one frame is divided into two fields in order to improve the response speed of from black to while display. In this case, at the time of the response from black to white, the white voltage is divided into two fields (one frame) FD1, FD2 and applied to the pixel of the black display. As a matter of course, even only by the above, writing of the second field FD2 starts from the luminance reached in the first field FD1, and thus a capacitor change of the liquid crystal is small, so that the response speed is improved due to a reduced influence of the two-step response. Thereby, a response time τ on (response time from black to white), which is about 12 ms in the normal driving, is improved to be about 7 ms in the one-frame two-division driving 401.

Further, as in a one-frame two-division driving 402 in FIG. 4, by applying data of a halftone value existing in the first field FD1 and thereafter applying a white voltage in the second field FD2, the response speed may be able to be made faster than in the case of applying the white voltage twice as in the above-described driving 401. Since the tone value inserted in the first field FD1 depends on a design of the pixel and a response characteristic of the liquid crystal, the most appropriate tone value should be selected in each panel.

As a result of our experiment, a response time (time of a luminance ratio of 10% to 90%) T4 in a case that white voltages (of the same polarity) of 255 tone values are applied both to the first and second fields FD1, FD2 is 6.97 ms, while a response time T5 in a case that halftone voltages of 208 tone values are applied in the first field FD1 is 4.97 ms, becoming shorter.

Frame times of the first field FD1 and the second field FD2 are not required to be exactly halves of the time of one frame FR1. Rather, a case that a tone value with a changed ratio is applied to the first frame FD1 may be sometimes more effective for the response speed. In other words, as for times of "n" fields divided from one frame, at least one field time can be different from other field times.

However, in the case of the above-described driving 402, there occurs a problem that though the response speed itself is improved as a result of a steep incline of the luminance waveform after the response starts, a rise 403 of the response is slowed by applying the tone value smaller than the white voltage in the first field FD1 (the response of the liquid crystal has a faster rise as the voltage becomes high). This corresponds to a prolonged black display time from a previous frame, and it is confirmed that, if a black letter is displayed as a moving image on a white background, for example, a letter width becomes broader than normal. In other words, moving image performance is influenced.

Figure 5:
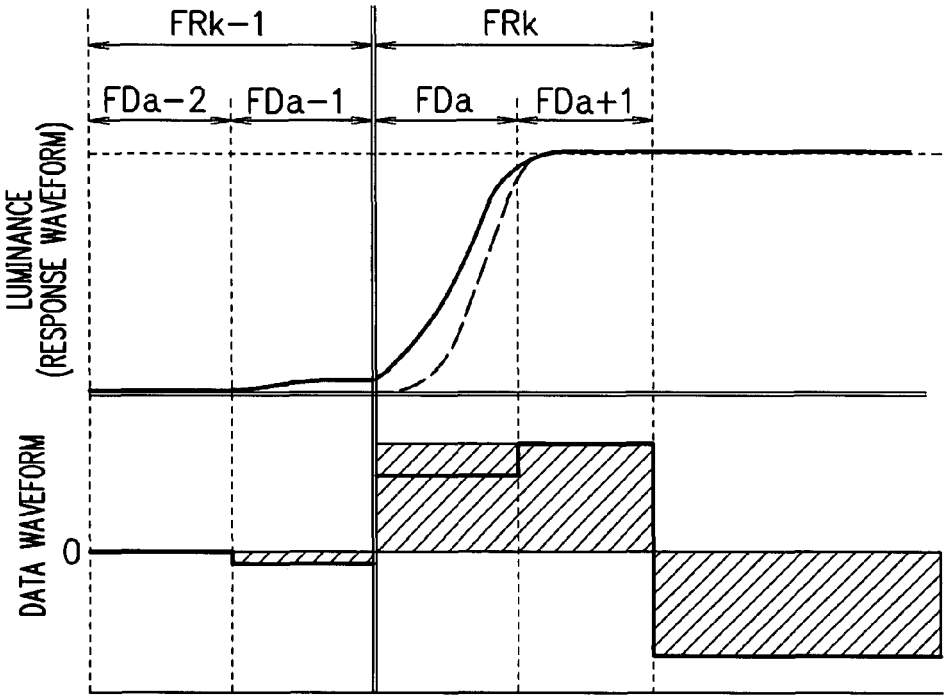
FIG. 5 is a graph showing a previous field low tone value of the second embodiment.

As a measure to cope with this problem, it is considered to perform a tone insertion of a low tone value in the second field of the previous frame in order for a high-speed rise of the above-described response waveform in the first field. FIG. 5 is a graph showing a data waveform and a response waveform of the luminance in a "k−1"th frame FRk-1 and a "k"th frame FRk. When a data voltage waveform of a fine line is applied, a luminance response waveform of a broken line is formed. When a data voltage waveform of a heavy line is applied, a luminance response waveform of a solid line is formed. The data voltage waveform is of an AC type, in which positive and negative signals are reversed per frame.

In a case that it is presumed that a white display is performed in the "k"th frame FRk and that a present field (a first filed of the "k"th frame FRk) is an "a"th field, when frame data in an "a−2"th field FDa-2 and an "a−1"th field FDa-1 is compared with frame data in the "a"th field FDa, and if the "a−1"th field FDa-1 and the "a−2" field FDa-2 are of black display, a predetermined conversion is performed to the data of the "a−1"th field FDa-1. On this occasion, a conversion method should be determined so that an absolute value of the data of the "a−1"th field FDa-1 is equal to or smaller than an absolute value voltage of a tone value of a luminance of 10% of an ultimate luminance in the "k"th frame FRk and so that a voltage higher than an absolute value voltage of black (minimum tone value) is selected. Here, it is supposed a case that one frame is divided into two fields.

Even if a tone value exceeding 10% cited above is selected, the effect in the response speed may be brought about. However, the luminance already exceeds 10% of the ultimate luminance of the "k"th frame FRk when the "a−1"th field FDa-1 and/or the "a"th field FDa start(s), so that a white afterimage tends to occur in a moving image, having an adverse effect.

As a result of employing the above method, the response speed is improved due to a quick rise from the beginning of the "a"th field FDa and the data voltage higher than the black (minimum tone value) voltage is applied in the "a−1"th field FDa-1, so that a direction is given to an alignment of liquid crystals, whereby an effect is brought about also on suppressing a luminance decrease due to disorder of the alignment at a time of application of a high voltage in the "k"th frame FRk.

Third Embodiment

When the black and white response in the above-described second embodiment is performed, in a case of a moving image in which only one color among RGB (red, green, blue), for example, has a black and white (two value) response and the other two colors has normal halftone responses, a response waveform of only the color having the black and white (two value) response rises from the beginning of the field, sometimes causing a large difference from the other colors in the response waveform. As a result, a colored blur or afterimage may occur.

In a third embodiment of the present invention, in order to cope with the above problem, a driving is performed so that there is applied for every response a tone value voltage to be 10% in a luminance of a present frame in the final field of the previous frame of the second embodiment.

By the above driving, response speeds not only in black and white but also in halftone are improved. Further, it is effective since an effect to a pixel electric potential of the previous frame can be made smaller as the number of field division becomes large, and since mostly dark tone values are inserted, an improvement effect can be obtained in a blur of a moving image by a hold type display.

However, in this case, since it is desirable that the response is completed at an earliest possible step in one field, combination use with a liquid crystal capable of coping with a high-speed response is necessary. Further, if one frame is divided into two fields, a half of the one frame has mostly a black luminance, and so a measure for reduction of the luminance is also required.

Fourth Embodiment

If one frame is divided into two fields, a writing time to a pixel is also reduced. When a 60 Hz driving is performed, a gate pulse time is 1/60/768=21.7 μs in a normal driving in a resolution of XGA, while a gate pulse time is 10.9 μs, being a half of the above, if one frame is divided into two fields. A gate pulse is applied to a gate line per field. It is obvious that if one frame is divided into "n" fields, the writing time becomes further shorter.

What becomes a problem then is writing ability of a TFT. Though a reason for dividing one frame into two fields is to improve a response speed, if writing is insufficient, the improvement of the response speed is not possible and even a difference in driving ability due to a liquid crystal panel environment cannot be covered, leading to poor reliability.

Thus, as a method of securing the writing ability while performing field division to improve the response speed, a multiscan driving of a gate is performed.

Figure 6:
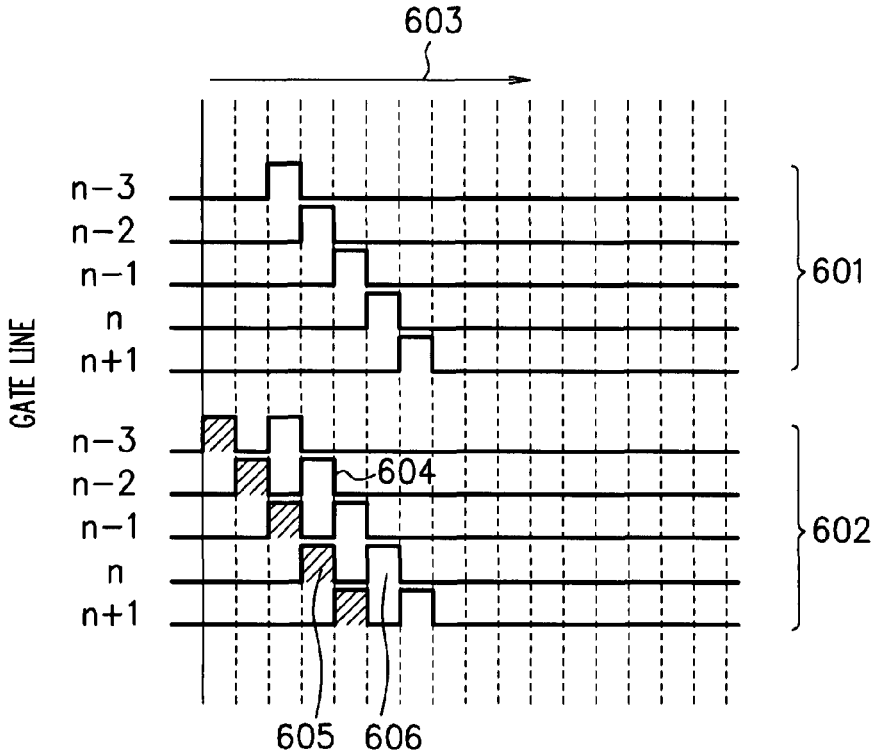
FIG. 6 is a diagram showing a multiscan concept of a fourth embodiment.

FIG. 6 is a diagram showing a normal driving 601 and a multiscan driving 602. An arrow 603 indicates a time axis. In the normal driving 601, one gate pulse is supplied per one gate line. In contrast, in the multiscan driving 602, two gate pulses of a prewriting and a writing are supplied per one gate line in every field. It is a method, for example, in which a gate pulse 605 for a prewriting of a gate line of a "n"th line is provided when a pulse 604 for writing a gate line of an "n−2"th line is applied, and both are written simultaneously. Thereby, by performing two writings of the gate pulse 605 for the prewriting and the gate pulse 606 for the writing, the writing of the "n"th line compensates the lack of the writing ability of the TFT. As a matter of course, the prewriting is not limited to one, and two or more prewritings are possible if the "n"th line is written at a time of a writing of an "n−(even number)"th gate line.

A reason why the prewriting is performed even-number lines before the "n"th line is to match polarizations of the pixels to which writing is performed. In this case, there is considered a dot inversion driving in which data voltage polarizations are alternately reversed in a direction of pixel alignment. The same thing holds for a horizontal line inversion.

Figure 7A:
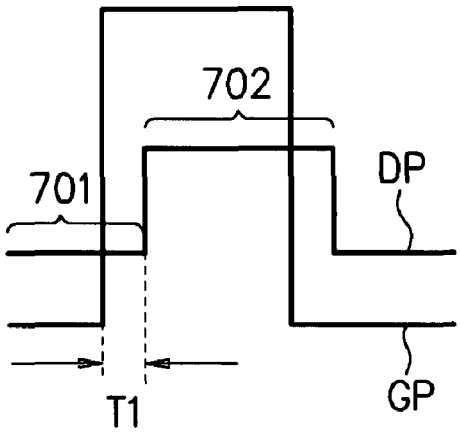
FIG. 7A is a diagram showing a data hold time of the fourth embodiment.

What is a problem then is a data hold time. As shown in FIG. 7A, a data hold time T1 is a time difference between rise times of a data pulse DP and a gate pulse GP, and is usually set to be about 2 to 3 ms with distortion of a waveform of the gate pulse GP being considered. The gate pulse GP is a pulse applied to the gate line, while the data pulse DP is a pulse applied to the data line. It is usual that the gate pulse GP rises first. By the multiscan driving 602, the prewriting is performed in the pixel of the "n"th line and the voltage is held until a writing of the "n"th line. The data pulse DP has a negative data voltage 701 of an "n−1"th line and a positive data voltage 702 of the "n"th line. When the gate pulse GP rises at the time of the writing of the "n"th line, the data 701 with the reverse polarization of the "n−1"th line is written, so that in the data pulse DP the prewritten voltage is reduced.

Figure 7B:
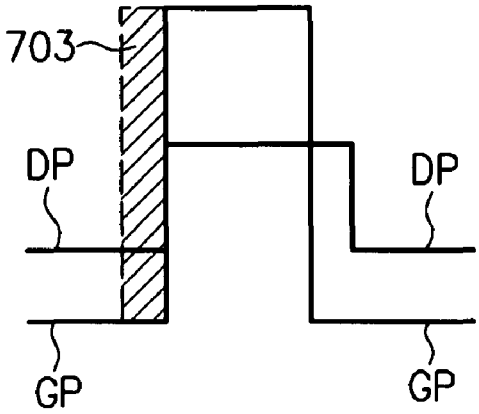
FIG. 7B is a diagram showing a data hold time of the fourth embodiment.
Figure 8:
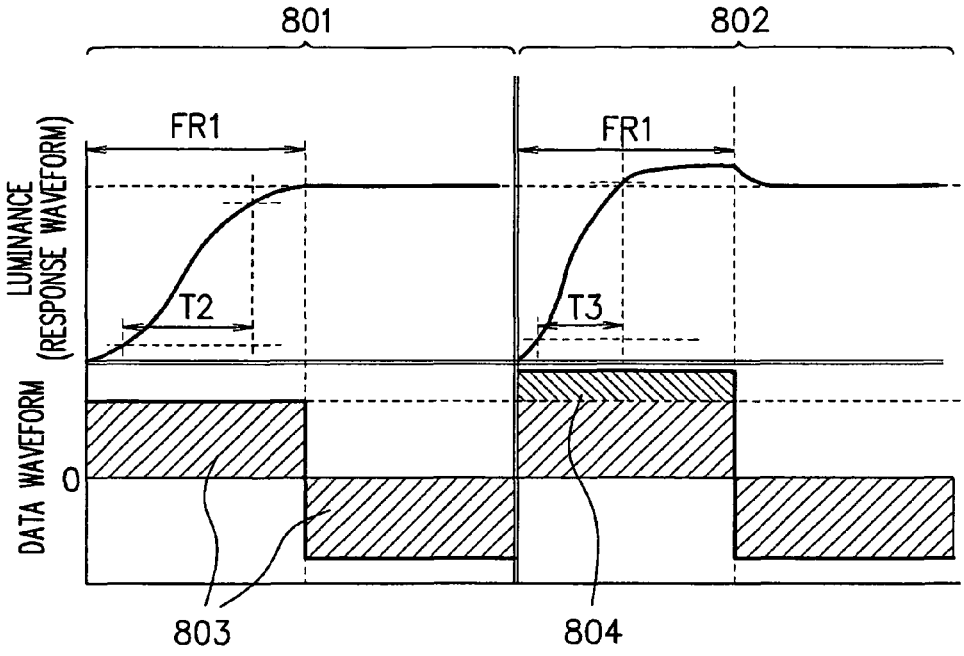
Background Art FIG. 8
FIG. 8 is a graph showing an overdrive technology according to a conventional technology.
Figure 9:
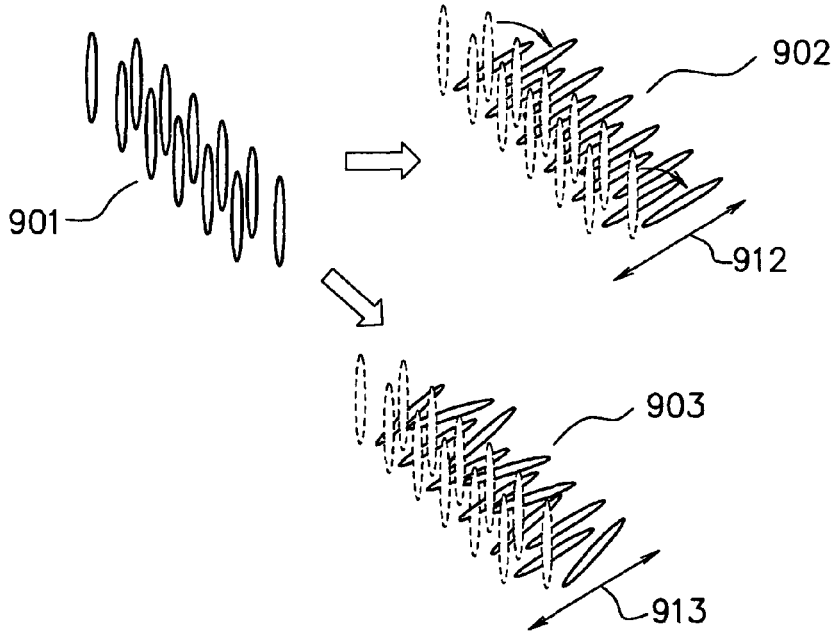
Background Art FIG. 9
FIG. 9 is a view showing abnormal alignment of liquid crystal molecules at a time of high voltage application according to the conventional technology.
Figure 10:
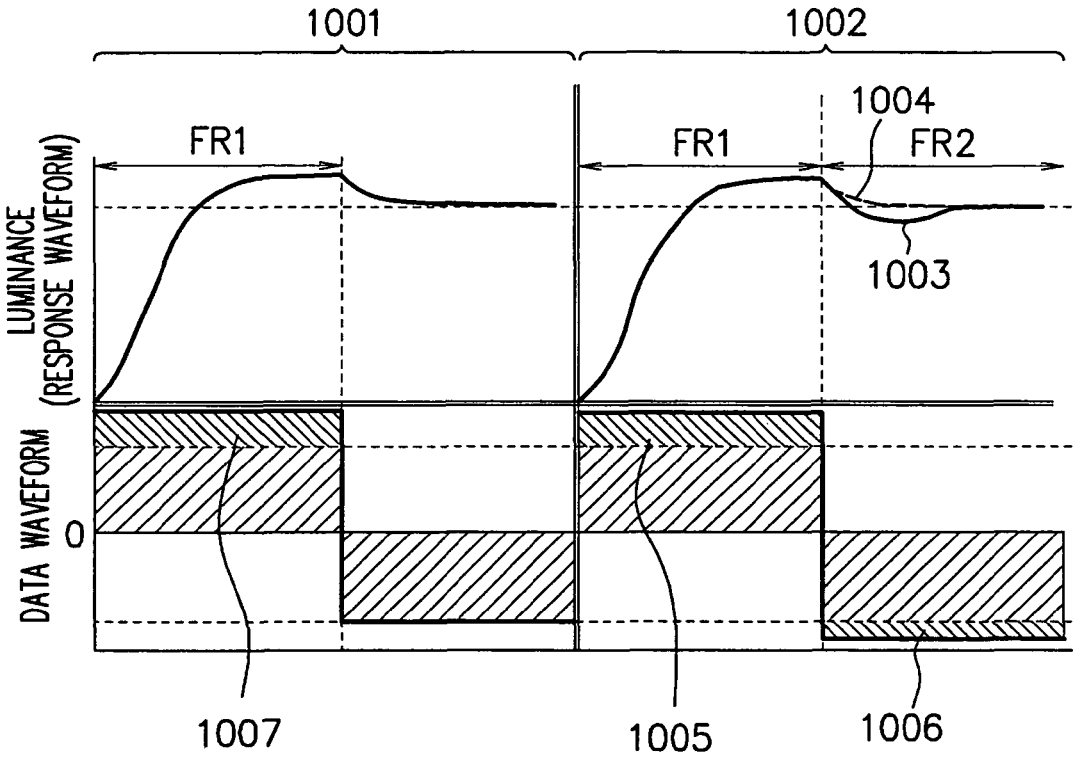
Background Art F I G. 10
FIG. 10 is a graph showing a response waveform at a time of the abnormal alignment of the liquid crystal molecules according to the conventional technology.

In order to prevent the above problem, it is effective to make the data hold time T1 be practically zero. In other words, as shown in FIG. 7B, there is employed a method in which a gate pulse 703 during the data hold time T1 from the rise of the gate pulse GP to the rise of the data pulse DP is deleted. The gate pulse GP rises simultaneously with the data pulse DP. Thereby, a writing of the data with the reverse polarizations does not occur, and by securing a data hold time of a fall time of the gate pulse GP, it is possible to cope with the gate pulse waveform distortion. Besides, a two-field division driving in which writing ability can be sufficiently kept can be realized, so that improvement of the response speed becomes possible.

As stated above, according to the first to fourth embodiments, by dividing one frame into "n" fields and applying a data voltage having undergone a predetermined conversion in all fields, a response within 1/n frame period time can be realized.

By divining one frame period into "n" fields and using converted data for data voltages of all fields, it becomes possible to provide a liquid crystal display device which is not only improved in a response speed but also is superior in a moving image characteristic.

The present embodiments are to be considered in all respects as illustrative and o restrictive, and all changes which come within the meaning and range of equivalency of the claims are therefore intended to be embraced therein. The invention may be embodied in other specific forms without departing from the spirit or essential characteristics thereof.

INDUSTRIAL APPLICABILITY

By dividing one frame into a plurality of fields to perform display, a response speed is increased and superior moving image display can be performed.

What is claimed is:

1. A liquid crystal display device comprising:

a liquid crystal panel including a plurality of gate lines to select a pixel and a plurality of data lines to supply pixel data;

a drive circuit dividing one frame into a plurality of fields, converting frame data to field data and a data driver supplying the field data to the data line, wherein said drive circuit generates data of each field of an "m−1"th frame based on data of an "m"th frame and the "m−1"th frame, and wherein a data absolute value voltage of a final field of the "m−1"th frame is higher than a minimum tone value absolute value voltage and equal to or lower than an absolute value voltage for a luminance of 10% of an ultimate luminance of the "m"th frame.

2. The liquid crystal display device according to claim 1, wherein said drive circuit generates data of each field of an "m"th frame based on data of the "m"th frame and an "m−1"th frame.

3. The liquid crystal display device according to claim 1, wherein all voltage polarizations of the data of "n" fields divided from the one frame are the same.

4. The liquid crystal display device according to claim 1, wherein at least one field time among times of the "n" fields divided from the one frame is different from the other field times.

5. The liquid crystal display device according to claim 1, further comprising a gate driver dividing one frame into a plurality of fields and supplying a gate pulse to the gate line, wherein a plurality of the gate pulses are supplied to each gate line per field.

6. The liquid crystal display device according to claim 5, wherein the gate pulse and the pixel data rise simultaneously.

7. The liquid crystal display device according to claim 1, wherein said liquid crystal panel includes an active element provided on a crisscrossing portion of the gate line and the data line, and part or all of the active element is formed of polysilicon.

8. The liquid crystal display device according to claim 1, wherein said drive circuit includes a timing controller.

9. The liquid crystal display device according to claim 8, wherein said drive circuit further includes a data converter.

10. The liquid crystal display device according to claim 9, wherein said drive circuit further includes a memory.

11. A driving method of a liquid crystal display device having a liquid crystal panel including a plurality of gate lines to select a pixel and a plurality of data lines to supply pixel data, the driving method of the liquid crystal display device comprising:

a data supply step of dividing one frame into a plurality of fields, converting frame data into field data and supplying the field data to the data line, wherein said data supply step generates data of each field of an "m−1"th frame based on data of an "m"th frame and the "m−1"th frame, and a data absolute value voltage of a final field of the "m−1"th frame is higher than a minimum tone value absolute value voltage and equal to or lower than an absolute value voltage for a luminance of 10% of an ultimate luminance of the "m"th frame.

12. The driving method of the liquid crystal display device according to claim 11, wherein said data supply step generates data of each field of an "m"th frame based on data of the "m"th frame and an "m−1"th frame.

13. The driving method of the liquid crystal display device according to claim 11, wherein all voltage polarizations of the data of "n" fields divided from the one frame are the same.

14. The driving method of the liquid crystal display device according to claim 11, wherein at least one field time among times of the "n" fields divided from the one frame is different from the other field times.

15. The driving method of the liquid crystal display device according to claim 11, further comprising a gate pulse supply step dividing one frame into a plurality of fields and supplying a gate pulse to the gate line, wherein a plurality of gate pulses are supplied to each gate line per field.

16. The driving method of the liquid crystal display device according to claim 15, wherein the gate pulse and the pixel data rise simultaneously.

17. The driving method of the liquid crystal display device according to claim 11, wherein the liquid crystal panel includes an active element provided on an crisscrossing portion of the gate line and the data line, and part or all of the active element is formed of polysilicon.

* * * * *